United States Patent [19]

Schoen et al.

[11] Patent Number: 4,554,029

[45] Date of Patent: Nov. 19, 1985

[54] LOCAL HEAT TREATMENT OF ELECTRICAL STEEL

[75] Inventors: Jerry W. Schoen, Hamilton; Russel L. Young, Collinsville, both of Ohio

[73] Assignee: Armco Inc., Middletown, Ohio

[21] Appl. No.: 439,884

[22] Filed: Nov. 8, 1982

[51] Int. Cl.[4] ..... H01F 1/04

[52] U.S. Cl. ..... 148/112; 148/111; 219/10.43; 219/155

[58] Field of Search ..... 148/110, 111, 112, 113, 148/121; 219/10.43, 155

[56] References Cited

U.S. PATENT DOCUMENTS

| | | | |
|---|---|---|---|
| 3,192,078 | 6/1965 | Gordon et al. | 148/121 |
| 3,276,922 | 10/1966 | Sery et al. | 148/121 |
| 3,477,883 | 11/1969 | Sery et al. | 148/121 |
| 3,953,252 | 4/1976 | Levin et al. | 148/121 |
| 3,990,923 | 11/1976 | Takashina et al. | 148/112 |
| 4,109,127 | 8/1978 | Frungel | 219/10.43 |
| 4,215,259 | 7/1980 | Rudd et al. | 219/10.43 |
| 4,234,776 | 11/1980 | Rudd et al. | 219/10.43 |
| 4,265,684 | 5/1981 | Boll | 148/121 |
| 4,312,684 | 1/1982 | Chraplyvy et al. | 148/121 |
| 4,363,677 | 12/1982 | Ichiyama et al. | 148/112 |

FOREIGN PATENT DOCUMENTS

| | | | |
|---|---|---|---|
| 8385 | 3/1980 | European Pat. Off. | 148/112 |
| 0033878 | 8/1981 | European Pat. Off. . | |
| 396061 | 12/1977 | U.S.S.R. | 148/121 |
| 652230 | 3/1979 | U.S.S.R. | 148/112 |

OTHER PUBLICATIONS

McGannon, The Making, Shaping and Treating of Steel, 8th ed., 1964, p. 1060.

Metals Handbook, vol. 4, Heat Treating, 1981, pp. 518 to 521.

*Primary Examiner*—John P. Sheehan

*Attorney, Agent, or Firm*—Frost & Jacobs

[57] ABSTRACT

A process for improving the core loss of magnetic materials of the type having a plurality of magnetic domains and which may have an insulative coating such as a mill glass, an applied coating, or both. The magnetic material is subjected to a local heat treatment employing radio frequency induction heating, radio frequency resistance heating, or electron beam resistance heating to induce artificial boundaries. Thereafter, the magnetic material is subjected to an annealing treatment.

5 Claims, 7 Drawing Figures

RD

LOCAL HEAT TREATMENT OF ELECTRICAL STEEL

TECHNICAL FIELD

The invention relates to the local heat treatment of electrical steels having an insulative coating thereon, e.g., a mill glass, a secondary coating, or both, and more particularly to the local heat treatment of such electrical steels by radio frequency resistance heating or radio frequency induction heating to improve core loss without damage to the insulative coating. Electron beam resistance heating can also be used if possible coating damage is not a concern.

BACKGROUND ART

The teachings of the present invention can be practiced on any magnetic material having domains of such size that refinement thereof would produce significant core loss improvement, such as cube-on-face oriented electrical steel (designated (100) [001] by Miller's Indices) and cube-on-edge oriented silicon steels. For purposes of an exemplary showing the invention will be described in its application to improvements in the core loss of cube-on-edge oriented electrical steels. In cube-on-edge oriented electrical steel, the body-centered cubes making up the grains or crystals are oriented in a cube-on-edge position, designated (110) [001] in accordance with Miller's Indices.

Cube-on-edge oriented silicon steels are well known in the art and are commonly used in the manufacture of cores for transformers and the like. Cube-on-edge electrical steels are produced by a number of routings typically involving one or more operations of cold rolling and one or more operations of annealing, so as to obtain a cold-rolled strip having a commercial standard thickness. After the cold rolling is completed, the strip may be subjected to a decarburizing anneal and coated with an annealing separator. Thereafter, the strip is subjected to a high temperature final anneal at a temperature of about 1200° C. As used herein and in the claims, the term "high temperature final anneal" refers to that anneal during which the cube-on-edge texture is produced as the result of secondary grain growth. The now-oriented electrical steel strip has its easiest axis of magnetization in the rolling direction of the strip so that it is advantageously used in the manufacture of magnetic cores for transformers and the like.

Various specific routings devised in recent years by prior art workers have resulted in cube-on-edge grain oriented silicon steels having markedly improved magnetic characteristics. As a consequence, such electrical steels are now considered to fall into two basic categories.

The first category is generally referred to as regular grain oriented silicon steel and is made by routings which normally produce a permeability at 796 A/m of less than 1870 with a core loss at 1.7 T and 60 Hz of greater than 0.700 W/lb when the strip thickness is about 0.295 mm.

The second category is generally referred to as high-permeability grain oriented silicon steel and is made by routings which normally produce a permeability at 796 A/m of greater than 1870 with a core loss less than 0.700 W/lb (at 1.7 T and 60 Hz) when the strip thickness is about 0.295 mm.

U.S. Pat. No. 3,764,406 is typical of those which set forth routings for regular grain oriented silicon steel.

For regular grain oriented silicon steel, a typical melt composition by weight percent may be stated as follows:

C: less than 0.085%
Si: 2%–4%
S and/or Se: 0.015%–0.07%
Mn: 0.02%–0.2%

The balance is iron and those impurities incident to the mode of manufacture.

In a typical but non-limiting routing for regular grain oriented silicon steel, the melt may be cast into ingots and reduced to slabs, continuously cast in slab form or cast directly into coils. The ingots or slabs may be reheated to a temperature of about 1400° C. and hot rolled to hot band thickness. The hot rolling step may be accomplished without reheating, if the ingot or slab is at the required rolling temperature. The hot band is annealed at a temperature of about 980° C. and pickled. Thereafter, the silicon steel may be cold rolled in one or more stages to final gauge and decarburized at a temperature of about 815° C. for a time of about 3 minutes in a wet hydrogen atmosphere with a dew point of about 60° C. The decarburized silicon steel is thereafter provided with an annealing separator, such as a coating of magnesia, and is subjected to a final high temperature box anneal in an atmosphere such as dry hydrogen at a temperature of about 1200° C. to achieve the desired final orientation and magnetic characteristics.

U.S. Pat. Nos. 3,287,183., 3,636,579; 3,873,381; and 3,932,234 are typical of those teaching routings for high-permeability grain oriented silicon steel. A non-limiting exemplary melt composition for such a silicon steel may be set forth as follows in weight percent:

Si: 2%–4%
C: <0.085%
Al (acid soluble): 0.01%–0.065%
N: 0.003%–0.010%
Mn: 0.03%–0.2%
S: 0.015%–0.07%

The above list includes only the primary oonstituents; the melt may also contain minor amounts of copper, phosphorus, oxygen and those impurities incident to the mode of manufacture.

In an exemplary, but non-limiting, routing for such high-permeability grain oriented silicon steel, the steps through the achievement of hot band thickness can be the same as those set forth with respect to regular grain oriented silicon steel. After hot rolling, the steel strip is continuously annealed at a temperature of from about 850° C. to about 1200° C. for from about 30 seconds to about 60 minutes in an atmosphere of combusted gas, nitrogen, air or inert gas. The strip is thereafter subjected to a slow cooling to a temperature of from about 850° C. to about 980° C., followed by quenching to ambient temperature. After descaling and pickling, the steel is cold rolled in one or more stages to final gauge, the final cold reduction being from about 65% to about 95%. Thereafter, the steel is continously decarburized in wet hydrogen at a temperature of about 830° C. for about 3 minutes at a dew point of about 60° C. The decarburized silicon steel is provided with an annealing separator such as magnesia and is subjected to a final box anneal in an atmosphere of hydrogen at a temperature of about 1200° C.

It is common practice, with respect to both types of grain oriented silicon steels, to provide an insulative coating having a high dielectric strength on the grain oriented silicon steel (in lieu of, or in addition to, a mill glass). The coating is subjected to a continuous anneal at a temperature of about 815° C. for about 3 minutes in order to thermally flatten the steel strip and to cure the insulative coating. Exemplary applied insulative coatings are taught in U.S. Pat. Nos. 3,948,786; 3,996,073; and 3,856,568.

The teachings of the present invention are applicable to both types of grain oriented electrical steels.

The pressure of increasing power costs has demanded that the materials used for transformer cores and the like have the lowest core loss possible. Prior art workers have long addressed this problem and have devised a number of methods (both metallurgical and non-metallurgical) to reduce the core loss of grain oriented electrical steels.

For example, from a metallurgical standpoint it is commonly known that core loss of oriented electrical steels can be decreased by increased volume resistivity, reduced final thickness of the sheet, improved orientation of the secondary grains, and by decreased size of the secondary grains. However, the process of secondary grain growth is neither well understood nor well controlled, often resulting in less than optimum control of the grain size and crystal texture, making it difficult to obtain grain oriented electrical steels having core losses closer to the theoretical limits. This problem is especially pronounced in those processes used to make high-permeability cube-on-edge grain oriented electrical steels, wherein larger than optimum secondary grain size is obtained. These circumstances have led a number of prior art workers to seek various non-metallurgical methods to improve core loss after the metallurgical processing is substantially complete.

One non-metallurgical approach is to apply a high-stress secondary coating onto the finished grain oriented electrical steel, as taught in U.S. Pat. No. 3,996,073. Such coatings place the grain oriented electrical steel strip in tension, which causes a decrease in the width of the 180° magnetic domains and the reduction of the number of supplementary domains. Since narrow 180° domains and few supplementary domains are desired in order to decrease the core loss of grain oriented electrical steels, such high-stress coatings are beneficial. However, the amount of tension or force that can be applied by these means is limited.

Another non-metallurgical approach is that of inducing controlled defects which is, in a sense, the creation of a substructure to limit the width of the 180° domains in the finished grain oriented electrical steel. A basic technique is taught in U.S. Pat. No. 3,647,575 wherein the finished grain oriented electrical steel is provided with narrowly spaced shallow grooves or scratches transverse the rolling direction and on opposite sides of the sheet. While a decrease in core loss is realized by this method, the insulative coating is damaged and the steel sheet is characterized by an uneven surface. These factors will result in increased interlaminar losses and decreased space factor, respectively, in a transformer fabricated from a steel so treated.

U.S.S.R. Author's Certificate No. 524,837 and U.S.S.R. Pat. No. 652,230 disclose other methods to induce artificial boundaries in a finally annealed grain oriented electrical steel by localized deformation resulting from bending or rolling and localized deformation resulting from a high energy laser treatment, respectively. The application of these methods result in the desired improvement in the core loss of the electrical steel sheet after a subsequent anneal. Nevertheless, these methods cannot be advantageously used because of damage to the integrity of the insulative coating and the sheet flatness which result from these treatments.

U.S. Pat. Nos. 4,203,784 and 4,293,350 disclose other methods wherein the finally annealed grain oriented electrical steel sheet is provided with artificial boundaries by inducing very fine linear strains resulting from scribing the surface of the sheet with either a roller or a pulsed laser. These methods have been advantageously employed to reduce the core loss of grain oriented electrical steels. However, the methods taught in these two references are limited to stacked core transformer designs where the transformer core is not annealed to relieve the stresses resulting from fabrication. The slight dislocation substructure induced by the methods of these two references will be removed upon annealing above from about 500° C. to about 600° C., while typical stress relief annealing is done at about 800° C. The damage done to the insulative coating (e.g., a mill glass, an applied coating, or both), even though less than by some other methods, is nontheless undesirable since very high interlaminar resistivity and coating integrity are desired for grain oriented electrical steels used in stacked core designs.

European Pat. No. 33878 teaches a method of laser treating according to U.S. Pat. No. 4,293,350, followed by a coating operation and heating the laser treated and coated sheet to about 500° C. to cure the coating. However, this technique necessitates additional processing steps and expense, and the improvement to the material will not withstand an anneal in excess of 600° C.

Co-pending application Ser. No. 403,714, filed July 30, 1982, in the names of Gary L. Neiheisel and Jerry W. Schoen, and entitled LASER TREATMENT OF ELECTRICAL STEEL teaches the treatment of magnetic materials of the type having domains of such size that refinement thereof would produce significant core loss improvement by a continuous wave laser. The magnetic material is scanned by the beam of the continuous wave laser across its rolling direction so as to subdivide the magnetic domains without damage to the insulative coating, resulting in improved core loss. Again the improvement to the material will not survive an anneal in excess of 600° C.

The present invention is based upon the discovery that magnetic materials having domains of such size that refinement thereof would produce significant core loss improvement can have artificial boundaries induced therein by local heat treatments employing radio frequency induction heating or resistance heating either by radio frequency resistance heating or by treatment with an electron beam, followed by an anneal. The resulting magnetic material not only is characterized by improved core loss, but also its insulative coating (if present) and its flatness are unimpaired. Furthermore, the artificial boundaries will survive any subsequent anneal. The process of the present invention is potentially safer and easier to maintain than a laser system, and is more energy efficient.

DISCLOSURE OF THE INVENTION

According to the invention, there is provided a process for improving the core loss of magnetic materials of the type having a plurality of magnetic domains of such size that refinement thereof would produce significant core loss improvement. The magnetic material is subjected to a local heat treatment employing a radio frequency resistance heat treatment, an electron beam resistance heat treatment or a radio frequency induction heat treatment to produce substantially parallel bands of heat treated regions extending substantially transverse to the rolling direction of the magnetic material, with regions of untreated areas therebetween. These electrical current heat treatments alter the microstructure within the locally heat treated bands or regions, thereby regulating the size of the magnetic domains. The local heat treatment step is followed by an anneal resulting in improved core loss of the magnetic material. In an exemplary application to regular grain oriented silicon steel or high-permeability grain oriented silicon steel, the finished and finally annealed electrical steel, having an insulative coating thereon, is subjected to local heat treatment wherein the heat treated bands are brought to a temperature above about 800° C. in less than 0.5 seconds, and preferably less than 0.15 seconds. The locally heat treated strip is then annealed at a temperature of from about 800° C. to about 1150° C. for a time of less than two hours.

DETAILED DESCRIPTION OF THE INVENTION

As indicated above, for purposes of an exemplary showing, the invention will be described in its application to regular and high-permeability cube-on-edge grain oriented electrical steels. The starting material of the present invention is an appropriate steel having a melt composition similar to those set forth above and produced by any known steel making process including a converter, an electric furnace or the like. The steel may be directly cast into coil form, or it may be fabricated into a slab by ingot or continuous casting methods and hot rolled into coil form. The hot-rolled or meltcast coil contains less than 6.5% silicon and certain necessary additions such as manganese, sulphur, selenium, aluminum, nitrogen, boron, tungsten, molybdenum and the like, or combinations thereof, to provide a dispersed phase according to the teachings of the art. The hot-rolled or meltcast coil is subjected to one or more cold rolling operations and, if necessary, one or more annealing operations so as to produce a strip of standard thickness. After the rolling is complete, the electrical steel may require decarburization in a wet hydrogen atmosphere. The grain orientation is then developed in the electrical steel sheet by a final high temperature anneal at about 1200° C. After the final high temperature anneal, the regular or high-permeability cube-on-edge grain oriented electrical steel may, if desired, be provided with an insulative coating which is dried and cured thereon, as indicated above. At this point, the finished grain oriented electrical steel is treated in accordance with the present invention. According to the present invention, the electrical steel strip is subjected to local heating, resulting in heat treated bands or band-like regions extending across the strip with intermediate untreated areas therebetween. This local heat treating can be accomplished by any appropriate method. Two excellent methods for this purpose are radio frequency resistance heating and radio frequency induction heating, as will be described hereinafter.

Figure 1:
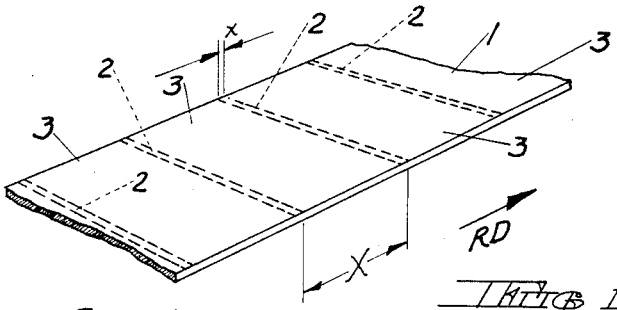
FIG. 1 is a fragmentary, semi-diagrammatic, perspective view of a cube-on-edge grain oriented electrical steel strip illustrating the locally heat treated bands thereof in accordance with the present invention.

Turning to FIG. 1, an electrical steel strip is fragmentarily shown at 1. FIG. 1 is semi-diagrammatic in nature and locally heat treated bands of the strip are indicated by broken lines at 2. Intermediate these bands there are untreated areas of the strip, indicated at 3. The heat treated bands 2 have a length (x) in the rolling direction of the strip 1 indicated by arrow RD. The untreated areas 3 have a length (X) in the rolling direction of strip 1.

FIG. 1 illustrates a simple instance in which the bands of local heating 2 extend across the strip in a direction substantially perpendicular to the rolling direction RD. It will be obvious to one skilled in the art that other angles to the rolling direction or other angular configurations of the bands 2 could be employed (such as criss-cross, zig-zag or the like). For example, the bands can lie at an angle of from about 30° to about 90° to the rolling direction RD.

In the practice of the present invention, it has been found that internal radio frequency currents can be employed for rapid local heat treatment of small regions or bands of the grain oriented electrical steel sheet. The most critical features of the application being the length (x) of the local heat treated regions and the length (X) of the untreated regions therebetween. The length (x) should be less than 1.5 mm, and preferably less than 0.5 mm. Keeping the length (x) as short as possible permits the subsequent use of less critical annealing treatments in order to obtain the optimum core loss. Achieving the minimum length (x) of the heat treated bands or regions depends on a number of variables including the design of the radio frequency heating device used, the time of the heat treatment cycle, and the oscillation frequency of the current employed. Treatment times of 0.26 seconds or less have been successfully employed, with times of 0.15 seconds or less being preferred. Furthermore, current oscillation frequencies of 450 kHz have been successfully used. Frequencies of 10 kHz to over 27 MHz could be applied.

While not wishing to be bound by theory, it is well known that the core loss of grain oriented electrical steels has both a hysteresis component and an eddy current component, the latter being reduced by a decrease in the spacing between the 180° magnetic domain walls. It is commonly known that the 180° wall spacing can be reduced with the introduction of defects, an effect which is analogous to grain size. According to the process of the present invention, rapid heating using radio frequency currents, introduced by either resistance or induction heating means, or resistance heating by an electron beam are employed to cause local plastic deformation in the heated bands or regions, due to the stress caused by the sharp thermal gradient. After a subsequent annealing treatment, these locally heat treated bands or regions provide permanent substructures which serve as artificial boundaries, reducing the spacing of the 180° domain walls in the grain oriented electrical steel, thus reducing the core loss thereof.

Figure 2:
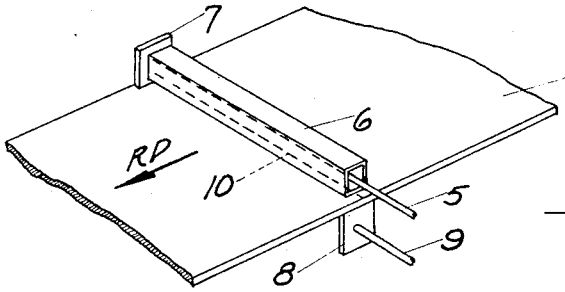
FIG. 2 is a fragmentary, semi-diagrammatic perspective view of a radio frequency resistance heating device for use in the practice of the present invention.
Figure 3:
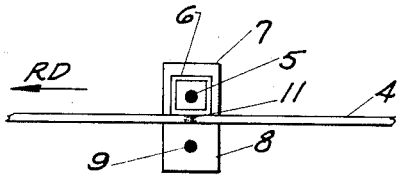
FIG. 3 is a fragmentary, end elevational view of the device of FIG. 2.

FIGS. 2 and 3 illustrate an exemplary non-limiting radio frequency resistance heating assembly. In these Figures, the electrical steel strip is shown at 4 having a rolling direction indicated by arrow RD. In the simple embodiment illustrated in these Figures, a conductor 5 extends transversely across the strip 4 in parallel spaced relationship to the strip. The conductor 5 comprises a proximity conductor and the casing 6 therefore may be made of any appropriate electrically insulating material such as fiberglass, silicon nitride or alumina. The casing 6 may be cooled, if desired, by any appropriate means (not shown). The conductor 5 is connected to a contact 7 of copper or other appropriate conductive material. The contact 7 rides upon the strip 4 at the edge of the strip. A second contact 8 is located on that side of the strip opposite the contact 7. A conductor 9 is affixed to contact 8. The conductors 5 and 9 are connected across a radio frequency power source (not shown). When power is applied to the device of FIGS. 2 and 3, current will flow in strip 4 between contacts 7 and 8 along a path of travel parallel to proximity conductor 5. This path of travel is shown in broken lines in FIG. 2 at 10. The electrical current in strip 4 will create a locally heated band in the strip (shown at 11 in FIG. 3) due to the electrical resistivity of the strip. The shape and width of the locally heat treated band or region is influenced by the high frequency resistance heating fixture design including the shape and diameter of the proximity conductor 5, the distance between the proximity conductor 5 and the surface of sheet 4, as well as the current oscillation frequency and the treatment time.

As indicated above, substantially parallel heat treated bands of the required length and spacing can be produced through the use of a scanning electron beam. The electron beam gun and that potion of the strip being resistance heat treated thereby must be maintained in a vacuum of at least $1\times10-4$ torr. This method is not preferred because of the vacuum requirement and the fact that damage to the insulative coating might occur.

Figure 4:
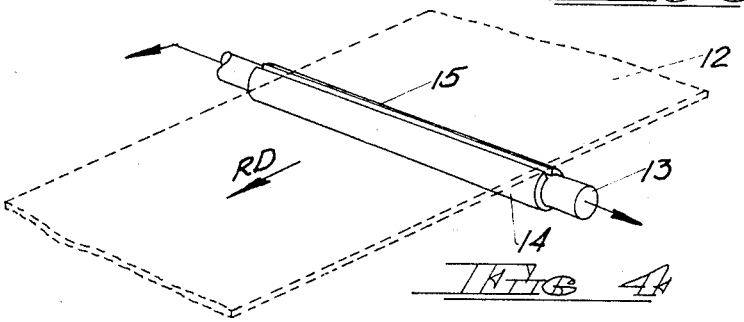
FIG. 4 is a fragmentary semi-diagrammatic perspective view of a radio frequency induction heating device for use in the practice of the present invention.
Figure 5:
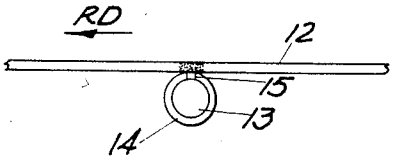
FIG. 5 is an end elevational view of the device of FIG. 4.

A non-limiting radio frequency induction heating device is illustrated in FIGS. 4 and 5. In these Figures, an electrical steel strip is fragmentarily shown at 12 in broken lines in FIG. 4 and in solid lines in FIG. 5. The strip 12 has a rolling direction indicated by arrow RD. The radio frequency induction heating device comprises a conductor 13 of copper, aluminum, or other appropriate conductive material surrounded by a core 14 of high-resistivity magnetic material such as ferrite. The core 14 has a longitudinally extending slot or gap 15 formed therein, which constitutes the inductor core air gap. The conductor 13 is connected across a source of radio frequency power (not shown).

A radio frequency electrical current passing through the conductor 13 will induce flux in the core 14, some of which is transferred into the steel strip 12 by virtue of the interruption of the magnetic circuit by the air gap 15. Local heat treating is accomplished due to the induced eddy currents and electrical resistivity of sheet 12. The shape and length of the locally heat treated region is influenced by the high frequency induction heating fixture design, including the width of gap 15 in the core 14 (at least about 0.076 mm), the proximity of strip 12 to gap 15, in addition to the current magnitude and frequency and the treatment time. That portion of core 14 defining gap 15 should be closely adjacent to, and preferably in contact with, the strip 12.

In the radio frequency resistance heating device of FIGS. 2 and 3 and in radio frequency induction heating device of FIGS. 4 and 5, narrow parallel heat treated bands are produced by causing the strips 4 and 12 to move in the direction of arrow RD. The individual heat treated bands are the result of pulsing the radio frequency current fed to the devices. In the radio frequency quency induction heating device of FIGS. 4 and 5, parallel spaced heat treated bands could be produced by rotating the ferrite core. Under these circumstances the core 14 could have more than one gap 15.

A feature of the local heat treatment process of the present invention lies in the fact that an insulative coating on the electrical steel treated will remain undamaged since the heat is generated within the underlying metal which resists the passage of an alternating current therethrough. The flatness of the strip being treated can be preserved by the application of a pressure in excess of 2.5 MPa during the treatment, preferably an isostatic pressure, which prevents thermally induced distortions in the strip. It will be understood by one skilled in the art that the amount of pressure required to maintain strip flatness will depend upon such variables as strip thickness, strip width, the design of the heating apparatus, etc. In the structure shown in FIGS. 2 and 3, pressure can be maintained on the strip 4 between casing 6 and a supporting surface (not shown) located beneath the strip. Similarly, in the structure shown in FIGS. 4 and 5, pressure can be maintained on the strip 12 between core 14 and a supporting surface (not shown) located above the strip.

After the local heat treatment, the strip is subjected to a stress relief anneal at a temperature of from about 815° C. to about 1115° C. in a vacuum or an atmosphere of hydrogen, argon or other inert gases, or a hydrogennitrogen atmosphere with due consideration of the temperatures being used, and for a time of less than two hours.

EXAMPLE

A high-permeability cube-on-edge grain oriented electrical steel, containing nominally 0.044% carbon, 2.93% silicon, 0.026% sulphur, 0.080% manganese, 0.034% aluminum and 0.0065% nitrogen (the balance being substantially iron and impurities incident to the mode of manufacture) was subjected to strip annealing at about 1150° C. and cold rolled to a final thickness of about 0.27 mm. The strip was then decarburized at 830° C. in a wet hydrogen atmosphere. The strip was further subjected to a final high temperature anneal at about 1150° C., having been coated with a magnesia separator. After removing the excess magnesia, samples of the finally annealed material were tested for core loss and thereafter were subjected to a local heat treatment using a radio frequency induction heating device of the type described with respect to FIGS. 4 and 5, producing heat treated bands or regions perpendicular to the rolling direction.

The local heating was accomplished using a current oscillation frequency of 450 kHz with a ferrite core having an air gap of 0.23 mm. The length (X) between the locally heat treated regions was about 8 mm. The length (x) of the locally heat treated bands or regions was about 0.23 mm. The samples were placed in intimate contact with the inductor core gap. After the local heat treatment the samples were re-tested, subjected to an anneal at a temperature of about 1115° C. in a hydrogen atmosphere, and again tested. The Table below sets forth the test results, from which the magnetic properties obtained with local heat treatment of the present invention can be compared to untreated control samples which were not locally heat treated, but which were the same in all other respects.

TABLE

| Sample No. | Heat Treatment Conditions Power Setting | Time | P17; 60 Core Loss, W/lb Before Treatment | After Treatment | Anneal 1115° C. | Core Loss Change |
|---|---|---|---|---|---|---|
| 1 | 10 | 0.26 sec | 0.642 | 1.532 | 0.646 | +0.004 |
| 2 | 30 | 0.26 | 0.649 | 1.644 | 0.641 | −0.008 |
| 3 | 50 | 0.26 | 0.631 | 1.649 | 0.637 | +0.006 |
| 4 | 50 | 0.11 | 0.626 | 1.417 | 0.624 | −0.002 |
| 5 | 120 | 0.26 | 0.580 | 1.729 | 0.575 | −0.005 |
| 6 | 120 | 0.18 | 0.631 | 1.555 | 0.614 | −0.017 |
| 7 | 120 | 0.11 | 0.679 | 1.658 | 0.654 | −0.025 |
| 8 | control | | 0.604 | — | 0.603 | −0.001 |
| 9 | control | | 0.580 | — | 0.580 | 0 |
| 10 | control | | 0.610 | — | 0.605 | −0.005 |

Time and power settings represent the measured variables for controlling energy delivered from the radio frequency source. Actual power measurements are relative to each device and experimental set-up.

Figure 6:
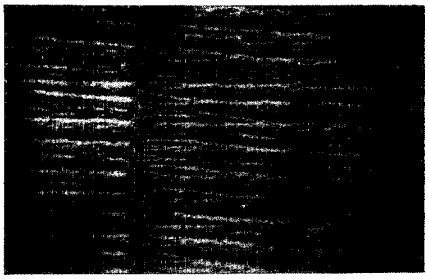
FIG. 6 is a 10 X photomicrograph of the magnetic domain structure of a grain oriented electrical steel sample after having been subjected to a local heat treatment and a stress relief anneal, in accordance with the present invention.
Figure 7:
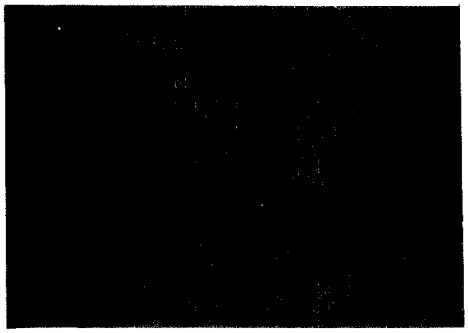
FIG. 7 is a 10 X photomicrograph of the magnetic domain structure of a grain oriented electrical steel sample processed in the same manner as the sample of FIG. 6, but not having been locally heat treated and annealed in accordance with the present invention.

As the data in the above Table illustrate, the core loss of the cube-on-edge grain oriented electrical steel was reduced as a result of the local heat treatment of the present invention, especially when the heat treatment time was restricted to 0.18 seconds or less. The domain refinement brought about by the local heat treatment is clearly shown by a comparison of FIGS. 6 and 7. FIG. 6 is a 3.5X photomicrograph of the magnetic domain structure of Sample No. 5. FIG. 7 is a 3.5X photomicrograph of the magnetic domain structure of control Sample No. 8.

Modifications may be made in the invention without departing from the spirit of it.

What is claimed is:

1. A process for improving the core loss of magnetic material of the type having a plurality of magnetic domains, said magnetic material being chosen from the class consisting of cube-on-edge regular grain oriented silicon steel strip, cube-on-edge oriented high-permeability grain oriented silicon steel strip and cube-on-face oriented silicon steel strip, said magnetic material having been subjected to a high temperature anneal to develop its grain orientation, said magnetic material having an insulative coating thereon chosen from the class consisting of a mill glass, an applied coating and an applied coating over a mill glass, said process comprising the steps of subjecting said magnetic material, after said high temperature grain orientation developing anneal to a local heat treatment by radio frequency induction heating or radio frequency resistance heating at a frequency of at least about 450 kHz so as to produce in said magnetic material narrow parallel bands of heat treated regions with untreated regions therebetween, said heat treated bands having a length (x) of less than 1.5 mm and said treated regions having a length (X) of at least 2 mm, said heat treatment for each of said bands being accomplished in less than 0.5 seconds, and thereafter annealing said locally heat treated magnetic material at a temperature of at least about 800° C. whereby to introduce artificial boundaries to decrease the 180° magnetic domain wall spacing of said magnetic material without degradation of said insulative coating.

2. The process claimed in claim 1 wherein said heat treated bands have a length (x) of less than 0.5 mm and said untreated regions have a length (X) of at least 2 mm.

3. The process claimed in claim 1 including the step of accomplishing said heat treatment for each of said bands in less than 0.15 seconds.

4. The process claimed in claim 1 including the step of applying a pressure of at least 2.5 MPa to said magnetic material during said heat treatment.

5. The process claimed in claim 1 wherein said heat treated bands extend across said silicon steel strip at an angle of from about 30° to about 90° to the rolling direction thereof.

* * * * *